US009170520B2

(12) United States Patent
Adachi

(10) Patent No.: US 9,170,520 B2
(45) Date of Patent: Oct. 27, 2015

(54) IMAGE FORMING APPARATUS HAVING REDUCED POWER CONSUMPTION

(71) Applicant: Brother Kogyo Kabushiki Kaisha, Nagoya-shi, Aichi-ken (JP)

(72) Inventor: Aya Adachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/291,376

(22) Filed: May 30, 2014

(65) Prior Publication Data

US 2014/0356006 A1 Dec. 4, 2014

(30) Foreign Application Priority Data

May 31, 2013 (JP) ..... 2013-115779

(51) Int. Cl.

| | |
|---|---|
| ***G03G 15/00*** | (2006.01) |
| ***G03G 15/02*** | (2006.01) |
| ***G03G 15/08*** | (2006.01) |
| ***G03G 15/16*** | (2006.01) |
| ***G03G 21/00*** | (2006.01) |
| *G03G 15/01* | (2006.01) |

(52) U.S. Cl.

CPC ..... *G03G 15/0266* (2013.01); *G03G 15/1675* (2013.01); *G03G 21/0005* (2013.01); *G03G 21/0064* (2013.01); *G03G 15/0194* (2013.01); *G03G 15/0291* (2013.01); *G03G 2221/0073* (2013.01)

(58) Field of Classification Search

CPC ..... G03G 15/50; G03G 21/0064; G03G 2215/1647; G03G 2215/1661; G03G 2221/0005; G03G 15/0266; G03G 15/0194; G03G 15/0291; G03G 15/1675; G03G 21/0005; G03G 2221/0073

USPC ..... 399/50, 66, 71, 101, 149

See application file for complete search history.

(56) References Cited

U.S. PATENT DOCUMENTS

| | | | | |
|---|---|---|---|---|
| 5,822,657 | A | 10/1998 | Hisada et al. | |
| 6,081,679 | A * | 6/2000 | Yamane et al. | 399/71 |
| 6,438,331 | B2 * | 8/2002 | Sakaizawa et al. | 399/50 |
| 2003/0194249 | A1 * | 10/2003 | Kawamura | 399/101 X |
| 2011/0262165 | A1 * | 10/2011 | Takeuchi et al. | 399/67 |
| 2012/0213547 | A1 * | 8/2012 | Sato | 399/101 |

FOREIGN PATENT DOCUMENTS

| | | | |
|---|---|---|---|
| JP | H09-305081 | A | 11/1997 |
| JP | 2004-252320 | A | 9/2004 |

* cited by examiner

*Primary Examiner* — Sophia S Chen
(74) *Attorney, Agent, or Firm* — Banner & Witcoff, Ltd.

(57) ABSTRACT

An image forming apparatus includes an image carrier, a charging member, a transfer member, a cleaning member and a control device configured to switch a first mode and a second mode. When executing the second mode, the control device applies a second charging bias having the same polarity as a first charging bias and having an absolute value smaller than the first charging bias to the charging member, applies a second transfer bias having the same polarity as a first transfer bias and having an absolute value smaller than the first transfer bias to the transfer member, and applies a second cleaning bias having the same polarity as the charged polarity of the toner to the cleaning member and sets a potential difference between a surface potential of the image carrier and the second cleaning bias within a predetermined range.

9 Claims, 7 Drawing Sheets

FIG. 3

| | | |
|---|---|---|
| CHARGING BIAS | YELLOW | +800V |
| | MAGENTA | +800V |
| | CYAN | +800V |
| | BLACK | +800V |
| TRANSFER CURRENT | YELLOW | -15 μA |
| | MAGENTA | -11 μA |
| | CYAN | -14 μA |
| | BLACK | -15 μA |
| DRUM CLEANING BIAS | YELLOW | -300V |
| | MAGENTA | -300V |
| | CYAN | -300V |
| | BLACK | -300V |
| BELT CLEANING BIAS | | OFF |

FIG. 4

| | | |
|---|---|---|
| CHARGING BIAS | YELLOW | +500V |
| | MAGENTA | +500V |
| | CYAN | +500V |
| | BLACK | +500V |
| TRANSFER CURRENT | YELLOW | -8 μA |
| | MAGENTA | -8 μA |
| | CYAN | -8 μA |
| | BLACK | -8 μA |
| DRUM CLEANING BIAS | YELLOW | +650V |
| | MAGENTA | +650V |
| | CYAN | +650V |
| | BLACK | +650V |
| BELT CLEANING BIAS | | -2kV |

FIG. 8

| | |
|---|---|
| CHARGING BIAS | +800V |
| DEVELOPING BIAS | +450V |
| TRANSFER CURRENT | -13 μA |
| DRUM CLEANING BIAS | -300V |

FIG. 9

| | |
|---|---|
| CHARGING BIAS | +500V |
| TRANSFER CURRENT | -8 μA |
| DRUM CLEANING BIAS | +650V |

IMAGE FORMING APPARATUS HAVING REDUCED POWER CONSUMPTION

CROSS-REFERENCE TO RELATED APPLICATIONS

This application claims priority from Japanese Patent Application No. 2013-115779 filed on May 31, 2013, the entire subject-matter of which is incorporated herein by reference.

TECHNICAL FIELD

The disclosure relates to an image forming apparatus of an electrophotographic type.

BACKGROUND

As an image forming apparatus of an electrophotographic type, there has been known an image forming apparatus including a photosensitive member on which a toner image is formed, a transfer device that transfers the toner image on the photosensitive member to an image receiving sheet and a collection member that collects transfer remaining toner on a surface of the photosensitive member after the toner image on the photosensitive member is transferred to the image receiving sheet.

In the above-described related-art image forming apparatus, after the transfer remaining toner on the surface of the photosensitive member is collected by the collection member, the transfer remaining toner collected to the collection member is discharged to the surface of the photosensitive member at predetermined timing and the discharged transfer remaining toner is collected to a toner removing device via the transfer device.

Further, there has been also known an image forming apparatus including a photosensitive member on which a toner image is formed, a developing unit that supplies toner to the photosensitive member and a cleaning roller that clings remaining toner on a surface of photosensitive member.

In the above-described related-art image forming apparatus, after the remaining toner on the surface of the photosensitive member is once clung by the cleaning roller, the remaining toner clung to the cleaning roller is discharged to the surface of the photosensitive member at predetermined timing and the discharged remaining toner is collected to the developing unit.

SUMMARY

Illustrative aspects of the invention provide an image forming apparatus capable of effectively returning transfer remaining toner from a cleaning member to an image carrier and reducing power consumption.

According to one illustrative aspect of the invention, there is provided an image forming apparatus comprising: an image carrier configured to carry a toner image thereon; a charging member configured to charge a surface of the image carrier; a transfer member configured to transfer the toner image from the image carrier to a transfer medium; a cleaning member configured to remove and hold an attached matter, which is attached to the image carrier, after the toner image has been transferred from the image carrier to the transfer medium; and a control device configured to switch a first mode and a second mode by controlling a charging bias applied to the charging member, a transfer bias applied to the transfer member and a cleaning bias applied to the cleaning member, wherein the first mode is a mode of forming an image, and wherein the second mode is a mode of returning the attached matter held on the cleaning member to the image carrier, wherein in a case of executing the first mode, the control device is configured to: apply a first charging bias having the same polarity as a charged polarity of toner to the charging member; apply a first transfer bias having a polarity opposite to the charged polarity of the toner to the transfer member; and apply a first cleaning bias having a polarity opposite to the charged polarity of the toner to the cleaning member, and wherein in a case of executing the second mode, the control device is configured to: apply a second charging bias having the same polarity as the first charging bias and having an absolute value smaller than the first charging bias to the charging member; apply a second transfer bias having the same polarity as the first transfer bias and having an absolute value smaller than the first transfer bias to the transfer member; and apply a second cleaning bias having the same polarity as the charged polarity of the toner to the cleaning member and set a potential difference between a surface potential of the image carrier and the second cleaning bias within a predetermined range.

According to another illustrative aspect of the invention, there is provided an image forming apparatus comprising: an image carrier configured to carry a toner image thereon; a charging member configured to charge a surface of the image carrier; a developing device configured to supply toner to the image carrier; a cleaning member configured to remove and hold an attached matter, which is attached to the image carrier; and a control device configured to switch a first mode and a second mode by controlling a charging bias applied to the charging member, a developing bias applied to the developing device and a cleaning bias applied to the cleaning member, wherein the first mode is a mode of forming an image, and wherein the second mode is a mode of returning the attached matter held on the cleaning member to the image carrier, wherein in a case of executing the first mode, the control device is configured to: apply a first charging bias having the same polarity as a charged polarity of toner to the charging member; apply a first developing bias having the same polarity as the charged polarity of the toner to the developing device; and apply a first cleaning bias having a polarity opposite to the charged polarity of the toner to the cleaning member, and wherein in a case of executing the second mode, the control device is configured to: apply a second charging bias having the same polarity as the first charging bias and having an absolute value smaller than the first charging bias to the charging member; apply a second developing bias having the same polarity as the first developing bias and having an absolute value smaller than the first developing bias to the developing device or not to apply a developing bias to the developing device; and apply a second cleaning bias having the same polarity as the charged polarity of the toner to the cleaning member and set a potential difference between a surface potential of the image carrier and the second cleaning bias within a predetermined range.

BRIEF DESCRIPTION OF THE DRAWINGS

FIG. 3 is a table showing setting values stored in a ROM of a control unit in the first illustrative embodiment, which shows setting values upon an image forming operation;

FIG. 4 is a table showing setting values stored in the ROM of the control unit in the first illustrative embodiment, which shows setting values upon a collection operation of transfer remaining toner;

FIG. 8 is a table showing setting values stored in a ROM of a control unit in the second illustrative embodiment, which shows setting values upon an image forming operation; and FIG. 9 is a table showing setting values stored in the ROM of the control unit in the second illustrative embodiment, which shows setting values upon a collection operation of transfer remaining toner.

DETAILED DESCRIPTION

General Overview

Figure 1:
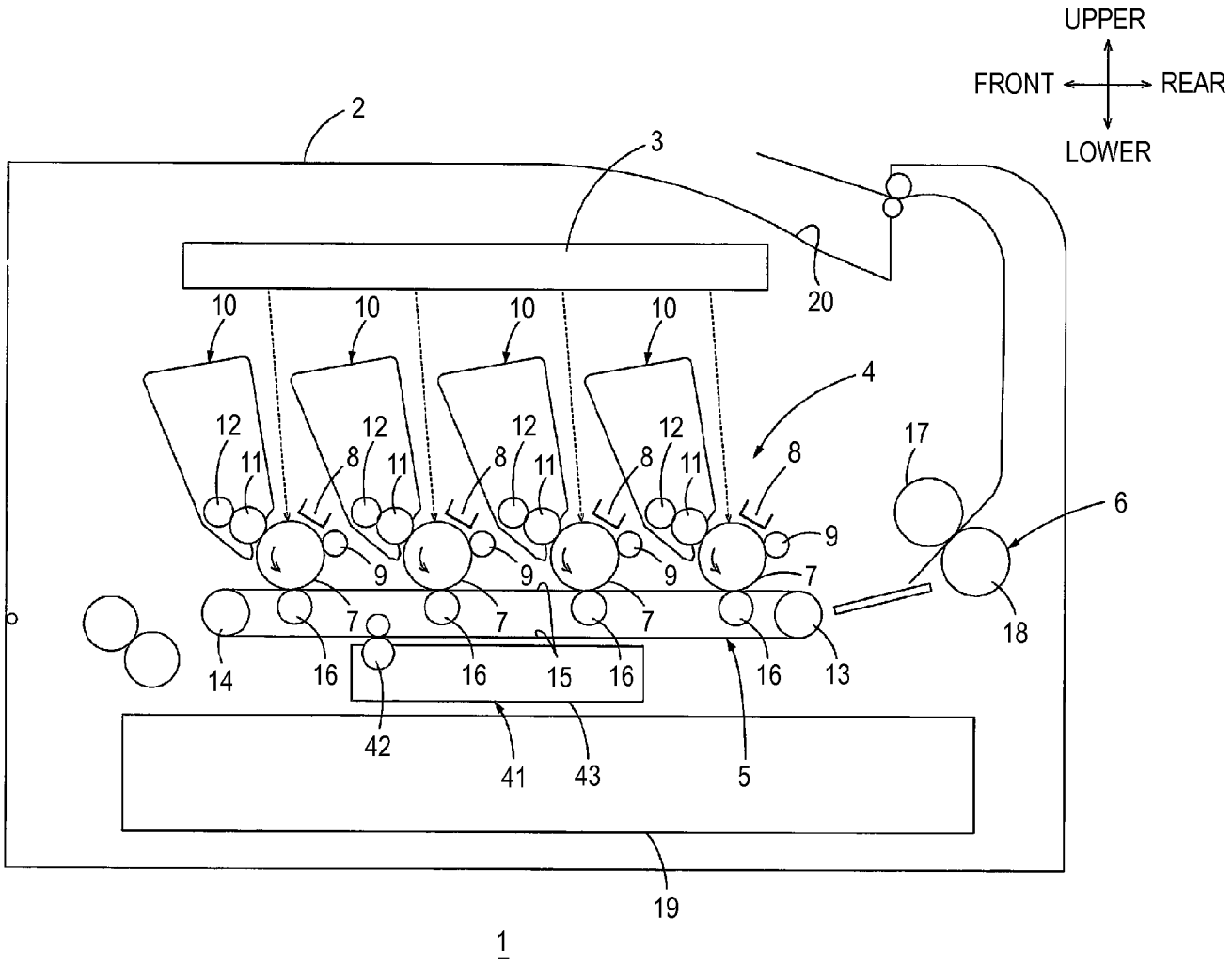
FIG. 1 is a central sectional view of a printer showing a first illustrative embodiment of an image forming apparatus of the invention.

There is a case where it is considered to reduce power consumption in the above-described related-art image forming apparatuses.

In this case, it is considered to reduce a voltage that is applied to the transfer device or developing unit.

However, if the voltage that is applied to the transfer device or developing unit is reduced, it is difficult to lower a surface potential of the photosensitive member when the photosensitive member is brought into contact with the transfer device or developing unit. In this case, a potential difference between the surface potential of the photosensitive member and a voltage that is applied to the collection member or cleaning roller is reduced, so that the discharge efficiency of the remaining toner from the collection member or cleaning roller to the photosensitive member is lowered.

Therefore, illustrative aspects of the invention provide an image forming apparatus capable of effectively returning transfer remaining toner from a cleaning member to an image carrier and reducing power consumption.

(1) According to one illustrative aspect of the invention, there may be provided an image forming apparatus comprising: an image carrier configured to carry a toner image thereon; a charging member configured to charge a surface of the image carrier; a transfer member configured to transfer the toner image from the image carrier to a transfer medium; a cleaning member configured to remove and hold an attached matter, which is attached to the image carrier, after the toner image has been transferred from the image carrier to the transfer medium; and a control device configured to switch a first mode and a second mode by controlling a charging bias applied to the charging member, a transfer bias applied to the transfer member and a cleaning bias applied to the cleaning member, wherein the first mode is a mode of forming an image, and wherein the second mode is a mode of returning the attached matter held on the cleaning member to the image carrier.

In a case of executing the first mode, the control device may be configured to: apply a first charging bias having the same polarity as a charged polarity of toner to the charging member; apply a first transfer bias having a polarity opposite to the charged polarity of the toner to the transfer member; and apply a first cleaning bias having a polarity opposite to the charged polarity of the toner to the cleaning member.

Further, in a case of executing the second mode, the control device may be configured to: apply a second charging bias having the same polarity as the first charging bias and having an absolute value smaller than the first charging bias to the charging member; apply a second transfer bias having the same polarity as the first transfer bias and having an absolute value smaller than the first transfer bias to the transfer member; and apply a second cleaning bias having the same polarity as the charged polarity of the toner to the cleaning member and set a potential difference between a surface potential of the image carrier and the second cleaning bias within a predetermined range.

According to the above configuration, in the case of executing the second mode, the control device lowers the charging bias, which is applied to the charging member, and also lowers the transfer bias that is applied to the transfer member.

Furthermore, at this time, the control device lowers the charging bias and the transfer bias so as to set the potential difference between the surface potential of the image carrier and the second cleaning bias within the predetermined range.

Thereby, while setting the potential difference between the surface potential of the image carrier and the second cleaning bias within a range capable of effectively returning the attached matter from the cleaning member to the image carrier, it is possible to reduce the power consumption.

As a result, it is possible to effectively return the attached matter from the cleaning member to the image carrier and to reduce the power consumption.

(2) According to another illustrative aspect, in the case of executing the second mode, the control device may be configured to apply the second transfer bias to the transfer member at a timing at which an area of a surface of the image carrier, which is charged by the second charging bias, faces the transfer member.

According to the above configuration, it is possible to securely set the potential difference between the surface potential of the image carrier and the second cleaning bias within a range capable of effectively returning the attached matter from the cleaning member to the image carrier.

(3) According to still another illustrative aspect, the image forming apparatus may further comprise: a plurality of the image carriers; a plurality of the charging members, each of which corresponds to a respective one of the plurality of the image carriers; a plurality of the transfer members, each of which corresponds to a respective one of the plurality of the image carriers; a plurality of the cleaning members, each of which corresponds to a respective one of the plurality of the image carriers; a belt that is positioned between each of the plurality of the image carriers and each of the plurality of the transfer members; and a second cleaning member configured to clean the belt, wherein in the case of executing the second mode, the control device may be configured to apply a third cleaning bias having a polarity opposite to the charged polarity of the toner to the second cleaning member.

According to the above configuration, the attached matters, which are discharged from the respective cleaning members, are transferred to the belt by the transfer bias and is then collected in a lump with the second cleaning member that cleans the belt.

Therefore, it is possible to gather the attached matters, which are attached to the respective image carriers, to one place with the second cleaning member.

(4) According to still another illustrative aspect, in the case of executing the first mode, the control device may be configured not to apply a bias to the second cleaning member.

According to the above configuration, it is possible to further reduce the power consumption.

(5) According to still another illustrative aspect, the image forming apparatus may further comprise a plurality of developing devices, each of which corresponds to the respective one of the plurality of the image carriers, and each of which is configured to supply the toner to the respective of the plurality of the image carriers, wherein in a case of executing the second mode, the control device may be configured to separate each of the plurality of the developing devices from the respective one of the plurality of the image carriers.

According to the above configuration, it is possible to securely prevent the discharged attached matter from being collected to the developing device and to securely collect the discharged attached matter with the second cleaning member.

(6) According to still another illustrative aspect, each of the plurality of the cleaning members may be electrically connected to a common power supply.

According to the above configuration, it is possible to simplify the configuration of the image forming apparatus, as compared to a configuration where the power supply is individually provided for each of the plurality of the cleaning members.

(7) According to still another illustrative aspect, the charging member may be a scorotron-type charger.

According to the above configuration, in the second mode, it is possible to reduce an amount of ozone generation from the charging member.

(8) According to still another illustrative aspect, the image forming apparatus may comprise a developing device configured to supply toner to the image carrier. The control device may be configured to control a charging bias applied to the charging member, a developing bias applied to the developing device and a cleaning bias applied to the cleaning member.

In this case, in a case of executing the first mode, the control device the control device may be configured to: apply a first charging bias having the same polarity as a charged polarity of toner to the charging member; apply a first developing bias having the same polarity as the charged polarity of the toner to the developing device; and apply a first cleaning bias having a polarity opposite to the charged polarity of the toner to the cleaning member.

Further, in a case of executing the second mode, the control device may be configured to: apply a second charging bias having the same polarity as the first charging bias and having an absolute value smaller than the first charging bias to the charging member; apply a second developing bias having the same polarity as the first developing bias and having an absolute value smaller than the first developing bias to the developing device or not to apply a developing bias to the developing device; and apply a second cleaning bias having the same polarity as the charged polarity of the toner to the cleaning member and set a potential difference between a surface potential of the image carrier and the second cleaning bias within a predetermined range.

According to the above configuration, in the case of executing the second mode, the control device lowers the charging bias, which is applied to the charging member, and also lowers the developing bias that is applied to the developing device.

Furthermore, at this time, the control device lowers the charging bias and the developing bias so as to set the potential difference between the surface potential of the image carrier and the second cleaning bias within the predetermined range.

Thereby, while setting the potential difference between the surface potential of the image carrier and the second cleaning bias within a range capable of effectively returning the attached matter from the cleaning member to the image carrier, it is possible to reduce the power consumption.

As a result, it is possible to effectively return the attached matter from the cleaning member to the image carrier and to reduce the power consumption.

(9) According to still another illustrative aspect, in the case of executing the second mode, the control device may be configured to apply the second developing bias to the developing device or stop the applying of the developing bias at a timing at which an area of a surface of the image carrier, which is charged by the second charging bias, faces the developing device.

According to the above configuration, it is possible to securely set the potential difference between the surface potential of the image carrier and the second cleaning bias within a range capable of effectively returning the attached matter from the cleaning member to the image carrier.

According to the image forming apparatus of the invention, it is possible to effectively return the attached matter from the cleaning member to the image carrier and to reduce the power consumption.

Exemplary Embodiments

1. Overall Configuration of Printer

As shown in FIG. 1, a printer 1 that is an example of the image forming apparatus is a direct tandem-type color laser printer of a horizontal arrangement type.

Meanwhile, in the below descriptions, the directions are described on the basis of a state where the printer 1 is horizontally put. That is, the upper of FIG. 1 refers to the upper and the lower of FIG. 1 refers to the lower. Further, the left of FIG. 1 refers to the front and the right of FIG. 1 refers to the rear. Further, the left and the right are described on the basis of a state where the printer 1 is seen from the front. That is, the front side of FIG. 1 is the right and the inner side of FIG. 1 is the left.

The printer 1 has a scanner unit 3, a process unit 4, a transfer unit 5 and a fixing unit 6 in a main body casing 2 having a substantial box shape.

The scanner unit 3 is arranged at an upper part in the main body casing 2. As shown with dotted lines, the scanner unit 3 emits laser beams, based on image data, towards photosensitive drums 7 (which will be described later) of the process unit 4, thereby exposing the photosensitive drums 7.

The process unit 4 is arranged below the scanner unit 3. The process unit 4 has a plurality of photosensitive drums 7 as an example of the image carrier, a plurality of scorotron-type chargers 8 as an example of the charging member, a plurality of drum cleaning rollers 9 as an example of the cleaning member, and a plurality of developing cartridges 10 as an example of the developing device.

The photosensitive drums 7 correspond to black, yellow, magenta and cyan, respectively. Each of the photosensitive drums 7 is supported to a lower end portion of the process unit 4 so that it is rotated in a counterclockwise direction, when seen from the right side. The photosensitive drums 7 are respectively arranged in parallel with each other at an interval in a front-rear direction. Each of the photosensitive drums 7 has a substantially cylindrical shape that is long in a left-right direction.

The scorotron-type chargers 8 correspond to the photosensitive drums 7, respectively, and are arranged at an interval from a rear-upper side of the corresponding photosensitive drums 7.

The drum cleaning rollers 9 correspond to the photosensitive drums 7, respectively, and are contacted to rear end portions of the corresponding photosensitive drums 7.

The developing cartridges 10 correspond to the photosensitive drums 7, respectively, and are arranged above the corresponding photosensitive drums 7. In the meantime, as described later, each of the developing cartridges 10 is configured so that it is contacted to or spaced from the corresponding photosensitive drum 7. Each of the developing cartridges 10 has a developing roller 11 as an example of the developer carrier and a supply roller 12. Further, the developing cartridge 10 accommodates toner corresponding to each color in a space above the developing roller 11 and the supply roller 12.

The developing roller 11 is rotatably supported to a lower end portion of the developing cartridge 10 so that it is exposed rearwards. Further, the developing roller 11 is contacted to a front-upper end portion of the photosensitive drum 7.

The supply roller 12 is arranged at a front-upper side of the developing roller 11. The supply roller 12 is contacted to a front-upper end portion of the developing roller 11.

The transfer unit 5 is arranged below the process unit 4. The transfer unit 5 has a driving roller 13, a driven roller 14, a conveyance belt 15 and a plurality of transfer rollers 16.

The driving roller 13 is arranged at a rear end portion of the transfer unit 5.

The driven roller 14 is arranged at a front end portion of the transfer unit 5 so that it is arranged at an interval in front of the driving roller 13 and faces the driving roller 13.

The conveyance belt 15 is wound around the driving roller 13 and the driven roller 14 so that an upper side thereof is contacted to all the photosensitive drums 7. The conveyance belt 15 circulates so that the upper side thereof is moved from the front towards the rear by driving rotation of the driving roller 13 and following movement of the driven roller 14.

The transfer rollers 16 correspond to the photosensitive drums 7, respectively, and are arranged below the corresponding photosensitive drums 7 with the upper side of the conveyance belt 15 being interposed therebetween.

The fixing unit 6 is arranged at the rear of the transfer unit 5. The fixing unit 6 has a heating roller 17 and a pressing roller 18 that contacts the heating roller 17.

When the printer 1 starts an image forming operation, the scorotron-type charger 8 uniformly charges a surface of the photosensitive drum 7. After that, the scanner unit 3 exposes the surface of the photosensitive drum 7. Thereby, an electrostatic latent image based on image data is formed on the surface of the photosensitive drum 7.

Further, the supply roller 12 supplies the toner in the developing cartridge 10 to the developing roller 11. At this time, the toner is positively friction-charged between the developing roller 11 and the supply roller 12 and is thus carried on the developing roller 11.

Then, the developing roller 11 supplies the carried toner to the electrostatic latent image on the surface of the photosensitive drum 7. Thereby, a toner image is carried on the surface of the photosensitive drum 7.

The sheet P that is an example of the recording medium is fed one by one from a sheet feeding tray 19 to between the yellow photosensitive drum 7 and the corresponding transfer roller 16 by rotations of the various rollers. Thereafter, the sheet P is conveyed from the front towards the rear by the conveyance belt 15. The toner image on the photosensitive drum 7 is transferred onto the sheet P by a transfer bias, which is applied to the transfer roller 16, when the sheet P passes between the photosensitive drum 7 and the transfer roller 16.

Then, the sheet P is heated and pressed when it passes between the heating roller 17 and the pressing roller 18. At this time, the toner image on the sheet P is heat-fixed on the sheet P. Then, the sheet P is discharged onto a sheet discharge tray 20.

2. Details of Printer (1) Scorotron-Type Charger

Figure 2:
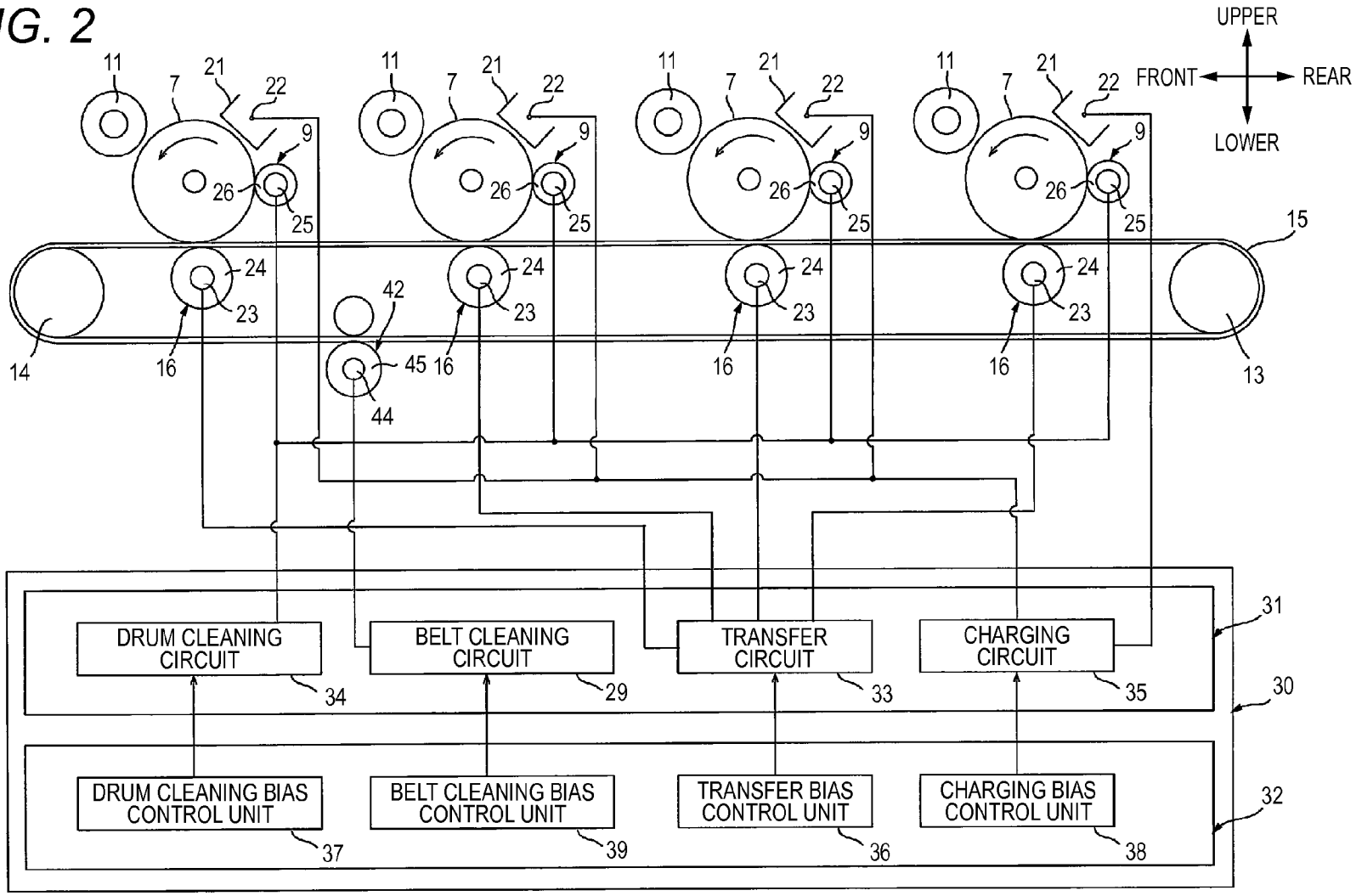
FIG. 2 is a block diagram showing main parts of an electrical configuration of the printer shown in FIG. 1.

As shown in FIG. 2, the scorotron-type charger 8 has a grid 21 and a charging wire 22.

The grid 21 has a substantially U-shaped cylindrical shape, when seen from the section, which extends in the left-right direction and opens towards in a rear-upper direction. The grid 21 is made of metal.

The charging wire 22 has a substantial line shape extending in the left-right direction. The charging wire 22 is tensioned in the left-right direction in the grid 21. The charging wire 22 is made of metal.

(2) Transfer Roller

The transfer roller 16 has a transfer roller shaft 23 and a transfer roller main body 24.

The transfer roller shaft 23 has a substantially cylindrical shape extending in the left-right direction. The transfer roller shaft 23 is made of metal.

The transfer roller main body 24 has a substantially cylindrical shape extending in the left-right direction. The transfer roller main body 24 covers the transfer roller shaft 23 so that both left and right end portions of the transfer roller shaft 23 are exposed. The transfer roller main body 24 is made of a conductive resin material and the like.

(3) Drum Cleaning Roller

The drum cleaning roller 9 has a drum cleaning roller shaft 25 and a drum cleaning roller main body 26.

The drum cleaning roller shaft 25 has a substantially cylindrical shape extending in the left-right direction. The drum cleaning roller shaft 25 is made of metal.

The drum cleaning roller main body 26 has a substantially cylindrical shape extending in the left-right direction. The drum cleaning roller main body 26 covers the drum cleaning roller shaft 25 so that both left and right end portions of the drum cleaning roller shaft 25 are exposed. The drum cleaning roller main body 26 is made of a foamed material of a semiconducting silicon resin or urethane resin.

(4) Belt Cleaner

As shown in FIGS. 1 and 2, the main body casing 2 has a belt cleaner 41.

The belt cleaner 41 is arranged below the transfer unit 5. The belt cleaner 41 has a transfer remaining toner accommodation member 43 and a belt cleaning roller 42 as an example of the second cleaning member.

The transfer remaining toner accommodation member 43 has a substantial box shape.

The belt cleaning roller 42 is rotatably supported to a rear-upper end portion of the transfer remaining toner accommodation member 43. An upper end portion of the belt cleaning roller 42 is exposed upwardly from the transfer remaining toner accommodation member 43 and is contacted to a lower side of the conveyance belt 15. The belt cleaning roller 42 has a belt cleaning roller shaft 44 and a belt cleaning roller main body 45.

The belt cleaning roller shaft 44 has a substantially cylindrical shape extending in the left-right direction. The belt cleaning roller shaft 44 is made of metal.

The belt cleaning roller main body 45 has a substantially cylindrical shape extending in the left-right direction. The belt cleaning roller main body 45 covers the belt cleaning roller shaft 44 so that both left and right end portions of the belt cleaning roller shaft 44 are exposed. The belt cleaning roller main body 45 is made of a foamed material of a semi-conducting silicon resin or urethane resin.

(5) Control Unit

The main body casing 2 has a control unit 30 as an example of the control device.

The control unit 30 has a power supply board 31 as an example of the power supply and a control board 32.

The power supply board 31 has a transfer circuit 33, a drum cleaning circuit 34, a charging circuit 35 and a belt cleaning circuit 29.

The transfer circuit 33 is electrically connected to the respective transfer roller shafts 23 of the transfer rollers 16 through wirings. The transfer circuit 33 individually applies a transfer bias to each of the transfer rollers 16, under control of the control board 32.

The drum cleaning circuit 34 is electrically connected to the respective drum cleaning roller shafts 25 of the drum cleaning rollers 9 through wirings. The drum cleaning circuit 34 applies the same drum cleaning bias to all the drum cleaning rollers 9, under control of the control board 32.

The charging circuit 35 is electrically connected to the respective charging wires 22 of the scorotron-type chargers 8 through wirings. The charging circuit 35 applies the same charging bias to the yellow, magenta and cyan scorotron-type chargers 8 and individually applies a charging bias to the black scorotron-type charger 8, under control of the control board 32.

The belt cleaning circuit 29 is electrically connected to the belt cleaning roller shaft 44 of the belt cleaning roller 42 through a wiring. The belt cleaning circuit 29 applies a belt cleaning bias to the belt cleaning roller shaft 44, under control of the control board 32.

The control board 32 has a CPU and a memory such as a ROM. The control board 32 has a transfer bias control unit 36, a drum cleaning bias control unit 37, a charging bias control unit 38 and a belt cleaning bias control unit 39 which are implemented in a software manner by causing the CPU to perform program processing. The transfer bias control unit 36 controls the transfer circuit 33. The drum cleaning bias control unit 37 controls the drum cleaning circuit 34. The charging bias control unit 38 controls the charging circuit 35. The belt cleaning bias control unit 39 controls the belt cleaning circuit 29.

3. Image Forming Operation

When performing the image forming operation, each of the developing cartridges 10 is contacted to the corresponding photosensitive drum 7, as shown in FIG. 1.

Meanwhile, in FIG. 1, regarding the image forming operation, an operation of forming a color image is shown. Regarding the image forming operation, when forming a monochrome image, although not shown, the black developing cartridge 10 is contacted to the corresponding photosensitive drum 7, and the yellow, magenta and cyan developing cartridges 10 are spaced from the corresponding photosensitive drums 7. A mode of performing the image forming operation is an example of the first mode.

(1) Bias Setting

When performing the image forming operation, the control unit 30 switches the printer 1 to the first mode.

At this time, as shown in FIG. 3, the charging bias control unit 38 sets charging biases. The transfer bias control unit 36 sets transfer currents that are supplied between the photosensitive drums 7 and the transfer rollers 16. The drum cleaning bias control unit 37 sets drum cleaning biases. The belt cleaning bias control unit 39 turns off the belt cleaning circuit 29. That is, the belt cleaning bias is not applied in the first mode.

(2) Transfer Operation and Cleaning Operation

In the first mode, the charging bias control unit 38 controls the charging circuit 35 to thus apply the charging biases shown in FIG. 3 to all the scorotron-type chargers 8. The charging biases are examples of the first charging bias of yellow, magenta, cyan and black, respectively.

Further, the transfer bias control unit 36 controls the transfer circuit 33 to thus apply a transfer bias of −5 kV to the yellow transfer roller 16, a transfer bias of −3 kV to the magenta transfer roller 16, a transfer bias of −4 kV to the cyan transfer roller 16 and a transfer bias of −5 kV to the black transfer roller 16 so that the transfer currents shown in FIG. 3 are constantly supplied between the respective transfer rollers 16 and the corresponding photosensitive drums 7. The transfer biases are examples of the first transfer bias of yellow, magenta, cyan and black, respectively.

Further, the drum cleaning bias control unit 37 controls the drum cleaning circuit 34 to thus apply drum cleaning biases shown in FIG. 3 to all the drum cleaning rollers 9. The drum cleaning biases are examples of the first cleaning bias of yellow, magenta, cyan and black, respectively.

As a result, the surfaces of the photosensitive drums 7 are charged to +800V by the scorotron-type chargers 8.

After that, when the photosensitive drums 7 are respectively rotated, areas of the surfaces of the photosensitive drums 7, which are charged by the scorotron-type chargers 8, face the corresponding transfer rollers 16 with the conveyance belt 15 being interposed therebetween.

At this time, the toner images carried on the photosensitive drums 7 are transferred to the sheet P. Further, the surface potential of the yellow photosensitive drum 7 becomes +200V by the transfer current from the yellow transfer roller 16. The surface potential of the magenta photosensitive drum 7 becomes +250V by the transfer current from the magenta transfer roller 16. The surface potential of the cyan photosensitive drum 7 becomes +230V by the transfer current from the cyan transfer roller 16. The surface potential of the black photosensitive drum 7 becomes +200V by the transfer current from the black transfer roller 16.

Thereafter, when the photosensitive drums 7 are further rotated, the transfer remaining toner on each photosensitive drum 7, which is an example of the attached matter to be attached on the surface of the photosensitive drum 7 without being transferred to the sheet P, is contacted to the corresponding drum cleaning roller 9.

At this time, the transfer remaining toner is electrostatically held on the surface of the corresponding drum cleaning roller 9 by the drum cleaning bias.

4. Collection Operation of Transfer Remaining Toner

When the image forming operation as described above is not performed upon the warming up of the printer 1, for example, the transfer remaining toners held on the respective drum cleaning rollers 9 are collected to the belt cleaner 41 at predetermined timing. The mode of collecting the transfer remaining toners held on the respective drum cleaning rollers 9 to the belt cleaner 41 is an example of the second mode.

At this time, as shown in FIG. 2, each developing cartridge 10 is spaced from the corresponding photosensitive drum 7.

(1) Bias Setting

When collecting the transfer remaining toner to the belt cleaner 41, the control unit 30 switches the printer 1 to the second mode.

At this time, as shown in FIG. 4, the charging bias control unit 38 sets charging biases. The transfer bias control unit 36 sets transfer currents that are supplied between the photosensitive drums 7 and the transfer rollers 16. The drum cleaning bias control unit 37 sets drum cleaning biases. The belt cleaning bias control unit 39 sets a belt cleaning bias.

(2) Collection of Transfer Remaining Toner

In the second mode, the charging bias control unit 38 controls the charging circuit 35 to thus apply the charging biases shown in FIG. 4 to all the scorotron-type chargers 8. The charging biases are examples of the second charging bias of yellow, magenta, cyan and black, respectively.

Further, the drum cleaning bias control unit 37 controls the drum cleaning circuit 34 to thus apply the drum cleaning biases shown in FIG. 4 to all the drum cleaning rollers 9. The drum cleaning biases are examples of the second cleaning bias of yellow, magenta, cyan and black, respectively.

Further, the belt cleaning bias control unit 39 controls the belt cleaning circuit 29 to thus apply the belt cleaning bias shown in FIG. 4 to the belt cleaning roller 42. The belt cleaning bias is an example of the third cleaning bias.

As a result, the surfaces of the photosensitive drums 7 are charged to +500V by the scorotron-type chargers 8.

After that, when the photosensitive drums 7 are respectively rotated, areas of the surfaces of the photosensitive drums 7, which are charged by the charging biases shown in FIG. 4, face the corresponding transfer rollers 16 with the conveyance belt 15 being interposed therebetween.

At this time, the transfer bias control unit 36 controls the transfer circuit 33 to thus apply the transfer biases of −2 kV to the respective transfer roller 16 so that the transfer currents shown in FIG. 4 are constantly supplied between the transfer rollers 16 and the corresponding photosensitive drums 7. The transfer biases are examples of the second transfer bias of yellow, magenta, cyan and black.

In the meantime, the timing at which the transfer bias control unit 36 applies the transfer biases shown in FIG. 4 to the respective transfer rollers 16 is appropriately set, taking into consideration a relative arrangement of the scorotron-type charger 8 and the transfer roller 16, a rotating speed of the photosensitive drum 7 and the like.

Resultantly, each surface potential of the photosensitive drums 7 becomes +200V by the transfer current from the corresponding transfer roller 16.

Thereafter, when the photosensitive drums 7 are further rotated, respectively, the areas of the respective surfaces of the photosensitive drums 7, which have the surface potential of +200V, face the corresponding drum cleaning rollers 9.

Then, the transfer remaining toners held on the drum cleaning rollers 9 are discharged to the surfaces of the photosensitive drums 7 by the drum cleaning biases shown in FIG. 4.

At this time, a potential difference between each surface potential of the photosensitive drums 7 and the corresponding drum cleaning bias is set to be +450V.

Figure 5:
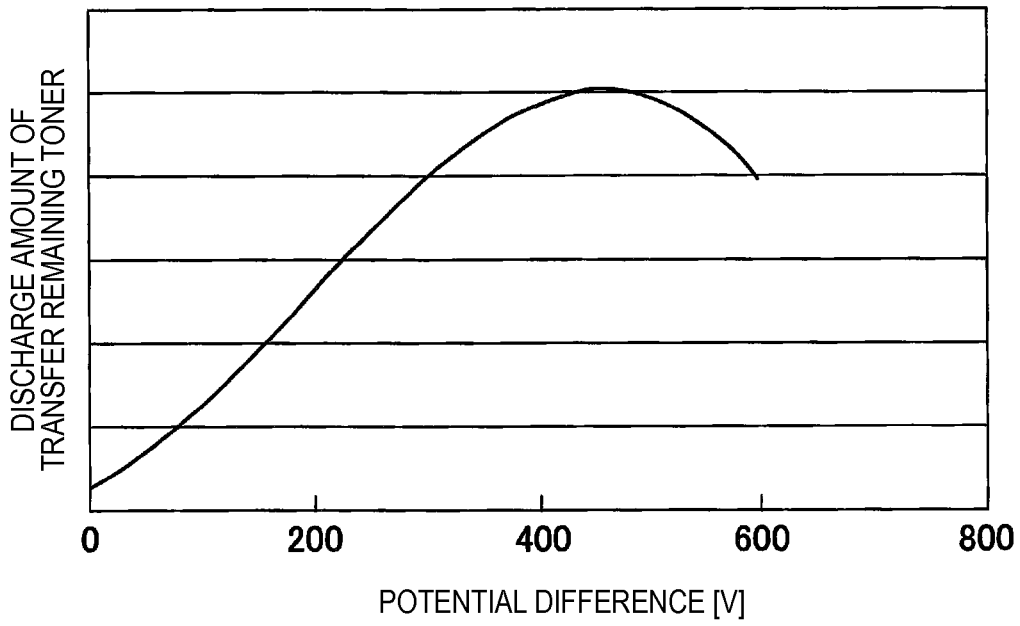
FIG. 5 is a graph showing a relation between a potential difference of a surface potential of a photosensitive drum and a drum cleaning bias and a discharge amount of the transfer remaining toner.

Here, as shown in FIG. 5, the discharge amount of the transfer remaining toner has a tendency that it is increased as the potential difference between the surface potential of the photosensitive drum 7 and the drum cleaning bias is gradually increased from 0V, reaches a maximum value and is then gradually decreased.

The potential difference between the surface potential of the photosensitive drum 7 and the drum cleaning bias is 80% or larger, preferably 90% or larger and 120% or smaller, preferably 110% or smaller, as compared to a potential difference at which the discharge amount of the transfer remaining toner is a maximum value.

Specifically, the potential difference between the surface potential of the photosensitive drum 7 and the drum cleaning bias is 400V or higher, preferably 450V or higher and 600V or lower, preferably 550V, for example.

When the photosensitive drums 7 are respectively further rotated, areas of the surfaces of the photosensitive drums 7, to which the transfer remaining toners are discharged, again face the transfer rollers 16 with the conveyance belt 15 being interposed therebetween.

Then, the transfer remaining toners on the photosensitive drums 7 are transferred to the surface of the conveyance belt 15.

Thereafter, the transfer remaining toners transferred on the surface of the conveyance belt 15 face the belt cleaning roller 42 as the conveyance belt 15 circulates.

Then, the transfer remaining toners are electrostatically attached to the belt cleaning roller 42 by the belt cleaning bias and is stored in the transfer remaining toner accommodation member 43.

In this way, the collection of the transfer remaining toners from the drum cleaning rollers 9 is completed.

5. Advantages (1) According to the printer 1, when collecting the transfer remaining toners to the belt cleaner 41, the control unit 30 lowers the charging biases, which are applied to the scorotron-type chargers 8, and also lowers the transfer biases, which are applied to the transfer rollers 16.

Furthermore, at this time, the control unit 30 lowers the charging biases and the transfer biases so that the potential difference between the surface potential of the photosensitive drum 7 and the drum cleaning bias becomes a predetermined value, specifically 450V.

Thereby, while setting the potential difference between the surface potential of the photosensitive drum 7 and the drum cleaning bias within a range capable of effectively returning the transfer remaining toners from the drum cleaning rollers 9 to the photosensitive drums 7, it is possible to reduce the power consumption.

As a result, it is possible to effectively return the transfer remaining toners from the drum cleaning rollers 9 to the photosensitive drums 7 and to reduce the power consumption.

(2) Further, according to the printer 1, when collecting the transfer remaining toners to the belt cleaner 41, the control unit 30 lowers the transfer biases at timing at which the areas of the surfaces of the photosensitive drums 7, which are charged by the charging biases shown in FIG. 4, face the transfer rollers 16.

For this reason, it is possible to securely set the potential difference between the surface potential of the photosensitive drum 7 and the drum cleaning bias within a range capable of effectively returning the transfer remaining toners from the drum cleaning rollers 9 to the photosensitive drums 7.

(3) Further, according to the printer 1, as shown in FIG. 2, the transfer remaining toners, which are discharged from the respective drum cleaning rollers 9, are transferred to the conveyance belt 15 and is then collected in a lump with the belt cleaning roller 42.

Therefore, it is possible to gather the transfer remaining toners attached to the respective photosensitive drums 7 to one place with the belt cleaning roller 42.

(4) Further, according to the printer 1, as shown in FIG. 3, when performing the image forming operation, the control unit 30 does not apply the belt cleaning bias to the belt cleaning roller 42.

Thereby, it is possible to further reduce the power consumption.

(5) Further, according to the printer 1, as shown in FIG. 2, when collecting the transfer remaining toners to the belt cleaner 41, the control unit 30 controls the respective developing cartridges 10 so that they are spaced from the respective photosensitive drums 7.

Thereby, it is possible to securely prevent the discharged transfer remaining toners from being collected to the developing cartridges 10 and to securely collect the discharged transfer remaining toners with the belt cleaning roller 42.

(6) Further, according to the printer 1, as shown in FIG. 2, the respective drum cleaning rollers 9 are electrically connected to the common power supply board 31.

More specifically, the drum cleaning circuit 34 of the power supply board 31 applies the same drum cleaning bias to all the drum cleaning rollers 9.

For this reason, it is possible to simplify the configuration of the printer 1, as compared to a configuration where the power is individually fed to the respective drum cleaning rollers 9.

(7) Further, according to the printer 1, as shown in FIGS. 3 and 4, when collecting the transfer remaining toners to the belt cleaner 41, the charging biases that are applied to the scorotron-type chargers 8 are lowered.

For this reason, it is possible to reduce an amount of ozone generation from the scorotron-type chargers 8.

6. Second Illustrative Embodiment

A second illustrative embodiment of the printer is described with reference to FIGS. 6 and 7. Meanwhile, in the second illustrative embodiment, the same members as those of the first illustrative embodiment are denoted with the same reference numerals and the descriptions thereof are omitted.

(1) Outline of Second Illustrative Embodiment

In the first illustrative embodiment, the printer 1 is configured as the color printer. However, in the second illustrative embodiment, a printer 51 is configured as a monochrome printer.

Figure 6:
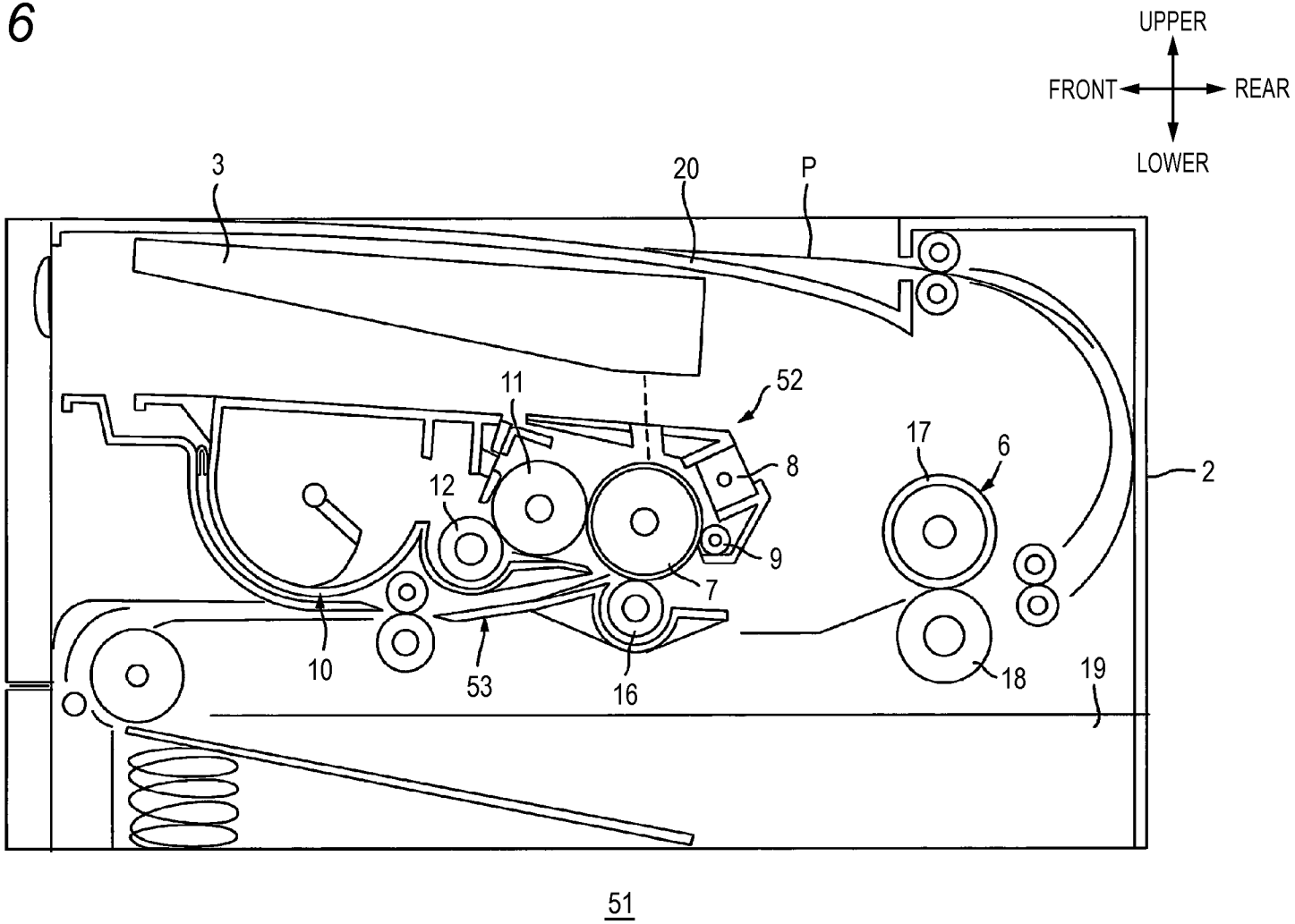
FIG. 6 is a central sectional view of a printer showing a second illustrative embodiment of an image forming apparatus of the invention.

Specifically, as shown in FIG. 6, the printer 51 has one process cartridge 52, instead of the four process units 4, and does not have the transfer unit 5 and the belt cleaner 41, in contrast to the first illustrative embodiment.

The process cartridge 52 has a developing cartridge 10 and a drum cartridge 53 configured to mount the developing cartridge 10 thereto.

In contrast to the first illustrative embodiment, the developing cartridge 10 is all the time contacted to the photosensitive drum 7 at a state where the developing cartridge 10 is mounted to the drum cartridge 53.

The drum cartridge 53 has the photosensitive drum 7, the scorotron-type charger 8, the drum cleaning roller 9 and the transfer roller 16, one by one.

(2) Details of Printer (2-1) Developing Roller

Figure 7:
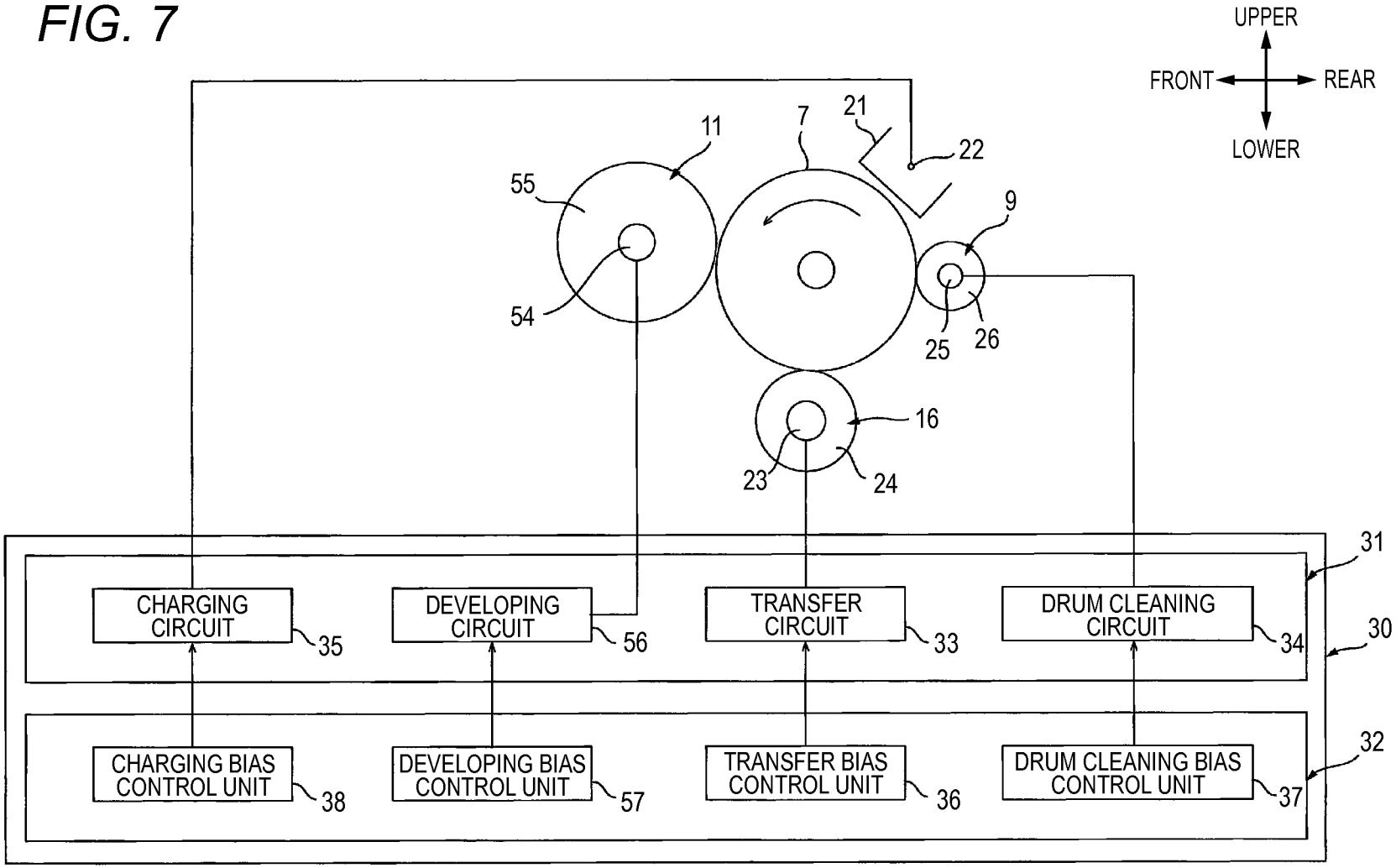
FIG. 7 is a block diagram showing main parts of an electrical configuration of the printer shown in FIG. 6.

As shown in FIG. 7, a developing roller 11 has a developing roller shaft 54 and a developing roller main body 55.

The developing roller shaft 54 has a substantially cylindrical shape extending in the left-right direction and the developing roller shaft 54 is made of metal.

The developing roller main body 55 has a substantially cylindrical shape extending in the left-right direction. The developing roller main body 55 covers the developing roller shaft 54 so that both left and right end portions of the developing roller shaft 54 are exposed. The developing roller main body 55 is made of a conductive resin material and the like.

(2-2) Control Unit

In the second illustrative embodiment, the power supply board 31 has a developing circuit 56.

The developing circuit 56 is electrically connected to the developing roller shaft 54 of the developing roller 11 via a wiring. The developing circuit 56 applies a developing bias to the developing roller 11 under control of the control board 32.

The control board 32 has a developing bias control unit 57.

The developing bias control unit 57 controls the developing circuit 56.

(3) Image Forming Operation (3-1) Bias Setting

When performing the image forming operation, the control unit 30 switches the printer 51 to the first mode.

At this time, as shown in FIG. 8, the charging bias control unit 38 sets a charging bias. The developing bias control unit 57 sets a developing bias. The transfer bias control unit 36 sets a transfer current that is supplied between the photosensitive drum 7 and the transfer roller 16. The drum cleaning bias control unit 37 sets a drum cleaning bias.

(2) Transfer Operation and Cleaning Operation

In the first mode, the charging bias control unit 38 controls the charging circuit 35 to thus apply the charging bias shown in FIG. 8 to the scorotron-type charger 8. The charging bias is an example of the first charging bias.

Further, the developing bias control unit 57 controls the developing circuit 56 to thus apply the developing bias shown in FIG. 8 to the developing roller 11. The developing bias is an example of the first developing bias.

Further, the drum cleaning bias control unit 37 controls the drum cleaning circuit 34 to thus apply the drum cleaning bias shown in FIG. 8 to the drum cleaning roller 9. The drum cleaning bias is an example of the first cleaning bias.

Then, when the image forming operation starts, the surface of the photosensitive drum 7 is charged to +800V by the scorotron-type charger 8.

After that, when the photosensitive drum 7 is rotated, the developing roller 11 supplies the toner to an electrostatic latent image on the surface of the photosensitive drum 7 by the developing bias.

Thereafter, when the photosensitive drum 7 is further rotated, the surface potential of the photosensitive drum 7 becomes +200V by the transfer current from the transfer roller 16 upon the transfer of the toner image carried on the photosensitive drum 7 to the sheet P.

Then, when the photosensitive drum 7 is further rotated, the transfer remaining toner, which is attached to the surface of the photosensitive drum 7 without being transferred to the sheet P, is contacted to the drum cleaning roller 9.

At this time, the transfer remaining toner is electrostatically held on the surface of the drum cleaning roller 9 by the drum cleaning bias.

7. Collection Operation of Transfer Remaining Toner

When the above image forming operation is not performed upon the warming up of the printer 51, for example, the transfer remaining toner held on the drum cleaning roller 9 is collected to the developing cartridge 10 at predetermined timing. The mode of collecting the transfer remaining toner held on the drum cleaning roller 9 to the developing cartridge 10 is an example of the second mode.

(1) Bias Setting

When collecting the transfer remaining toner to the developing cartridge 10, the control unit 30 switches the printer 51 to the second mode.

At this time, as shown in FIG. 9, the charging bias control unit 38 sets a charging bias. The developing bias control unit 57 turns off a developing bias. The transfer bias control unit 36 sets a transfer current that is supplied between the photosensitive drum 7 and the transfer roller 16. The drum cleaning bias control unit 37 sets a drum cleaning bias.

(2) Collection of Transfer Remaining Toner

When collecting the transfer remaining toner to the developing cartridge 10, the charging bias control unit 38 controls the charging circuit 35 to thus apply the charging bias shown in FIG. 9 to the scorotron-type charger 8. The charging bias is an example of the second charging bias.

Further, the drum cleaning bias control unit 37 controls the drum cleaning circuit 34 to thus apply the drum cleaning bias shown in FIG. 9 to the drum cleaning roller 9. The drum cleaning bias is an example of the second cleaning bias.

Then, when the collection operation of the transfer remaining toner starts, the surface of the photosensitive drum 7 is charged to +500V by the scorotron-type charger 8.

After that, when the photosensitive drum 7 is rotated, the area of the surface of the photosensitive drum 7, which is charged by the charging bias shown in FIG. 9, is contacted to the developing roller 11.

At this time, the developing bias control unit 57 controls the developing circuit 56 to thus turn off the developing bias.

Incidentally, in the second mode, the developing bias control unit 57 may apply a second developing bias having an absolute value smaller than the first developing bias to the developing roller 11. The timing at which the developing bias control unit 57 applies the second developing bias to the developing roller 11 or turns off the developing bias is appropriately set, taking into consideration a relative arrangement of the developing roller 11 to the scorotron-type charger 8, a rotating speed of the photosensitive drum 7 and the like.

In the meantime, at this time, since an electrostatic latent image is not formed on the surface of the photosensitive drum 7, the toner in the developing cartridge 10 is not supplied to the photosensitive drum 7.

Thereafter, when the photosensitive drum 7 is further rotated, the area of the surface of the photosensitive drum 7, which is charged by the charging bias shown in FIG. 9, is contacted to the transfer roller 16.

Resultantly, the surface potential of the photosensitive drum 7 is charged to +200V by the transfer bias.

Then, when the photosensitive drum 7 is further rotated, the area of the surface of the 7, which has the surface potential of +200V, faces the drum cleaning roller 9.

Then, the transfer remaining toner held on the drum cleaning roller 9 is discharged to the surface of the photosensitive drum 7 by the drum cleaning bias shown in FIG. 9.

At this time, the potential difference between the surface potential of the photosensitive drum 7 and the drum cleaning bias shown in FIG. 9 is 450V.

Then, when the photosensitive drum 7 is further rotated, the area of the surface of the photosensitive drum 7, to which the transfer remaining toner is discharged, faces the developing roller 11.

Then, the transfer remaining toner on the photosensitive drum 7 is transferred to the surface of the developing roller 11 and is collected into the developing cartridge 10.

In this way, the collection of the transfer remaining toner from the drum cleaning roller 9 is completed.

(3) Operational Effects of Second Illustrative Embodiment (3-1) According to the printer 51 of the second illustrative embodiment, as shown in FIG. 9, when collecting the transfer remaining toner to the developing cartridge 10, the control unit 30 lowers the charging bias to be applied to the scorotron-type charger 8 and the transfer current and turns off the developing bias that is applied to the developing roller 11.

Furthermore, at this time, the control unit 30 lowers the charging bias and the transfer current so that the potential difference between the surface potential of the photosensitive drum 7 and the drum cleaning bias becomes a predetermined value, specifically 450V, and also turns off the developing bias.

Thereby, while setting the potential difference between the surface potential of the photosensitive drum 7 and the drum cleaning bias within a range capable of effectively returning the transfer remaining toner from the drum cleaning roller 9 to the photosensitive drum 7, it is possible to reduce the power consumption.

As a result, it is possible to effectively return the transfer remaining toner from the drum cleaning roller 9 to the photosensitive drum 7 and to reduce the power consumption.

(2) Further, according to the printer 51, when collecting the transfer remaining toner to the developing cartridge 10, the control unit 30 turns off the developing bias or applies the second developing bias at timing at which the area of the surface of the photosensitive drum 7, which is charged by the charging bias shown in FIG. 9, faces the developing roller 11.

Therefore, it is possible to securely set the potential difference between the surface potential of the photosensitive drum 7 and the drum cleaning bias to the predetermined value.

8. Modified Embodiments

In the respective illustrative embodiments, the control board 32 has the CPU. However, the control board 32 may have an ASIC, i.e., an application specific integrated circuit, instead of the CPU.

What is claimed is:

1. An image forming apparatus comprising:

an image carrier configured to carry a toner image thereon;

a charging member configured to charge a surface of the image carrier;

a transfer member configured to transfer the toner image from the image carrier to a transfer medium;

a cleaning member configured to remove and hold attached matter, which is attached to the image carrier, after the toner image has been transferred from the image carrier to the transfer medium; and a control device configured to switch between a first mode and a second mode by controlling a charging bias applied to the charging member, a transfer bias applied to the transfer member and a cleaning bias applied to the cleaning member, wherein the first mode is a mode of forming an image, and wherein the second mode is a mode of returning the attached matter held on the cleaning member to the image carrier, wherein, in a case of executing the first mode, the control device is configured to:

apply a first charging bias having the same polarity as a charged polarity of toner to the charging member;

apply a first transfer bias having a polarity opposite to the charged polarity of the toner to the transfer member; and apply a first cleaning bias having a polarity opposite to the charged polarity of the toner to the cleaning member, and wherein, in a case of executing the second mode, the control device is configured to:

apply a second charging bias having the same polarity as the first charging bias and having an absolute value smaller than the first charging bias to the charging member;

apply a second transfer bias having the same polarity as the first transfer bias and having an absolute value smaller than the first transfer bias to the transfer member; and apply a second cleaning bias having the same polarity as the charged polarity of the toner to the cleaning member and set a potential difference between a surface potential of the image carrier and the second cleaning bias within a predetermined range.

2. The image forming apparatus according to claim 1, wherein, in the case of executing the second mode, the control device is configured to apply the second transfer bias to the transfer member when an area of a surface of the image carrier, which is charged by the second charging bias, faces the transfer member.

3. The image forming apparatus according to claim 1, further comprising:

a plurality of the image carriers;

a plurality of the charging members, each of which corresponds to a respective one of the plurality of the image carriers;

a plurality of the transfer members, each of which corresponds to a respective one of the plurality of the image carriers;

a plurality of the cleaning members, each of which corresponds to a respective one of the plurality of the image carriers;

a belt positioned between each of the plurality of the image carriers and each of the plurality of the transfer members; and a second cleaning member configured to clean the belt, wherein, in the case of executing the second mode, the control device is configured to apply a third cleaning bias having a polarity opposite to the charged polarity of the toner to the second cleaning member.

4. The image forming apparatus according to claim 3, wherein, in the case of executing the first mode, the control device is configured not to apply a bias to the second cleaning member.

5. The image forming apparatus according to claim 3, further comprising a plurality of developing devices, each of which corresponds to the respective one of the plurality of the image carriers, and each of which is configured to supply the toner to the respective one of the plurality of the image carriers, wherein, in a case of executing the second mode, the control device is configured to separate each of the plurality of the developing devices from the respective one of the plurality of the image carriers.

6. The image forming apparatus according to claim 3, wherein each of the plurality of the cleaning members is electrically connected to a common power supply.

7. The image forming apparatus according to claim 1, wherein the charging member is a scorotron-type charger.

8. An image forming apparatus comprising:

an image carrier configured to carry a toner image thereon;

a charging member configured to charge a surface of the image carrier;

a developing device configured to supply toner to the image carrier;

a cleaning member configured to remove and hold attached matter, which is attached to the image carrier; and a control device configured to switch between a first mode and a second mode by controlling a charging bias applied to the charging member, a developing bias applied to the developing device and a cleaning bias applied to the cleaning member, wherein the first mode is a mode of forming an image, and wherein the second mode is a mode of returning the attached matter held on the cleaning member to the image carrier, wherein, in a case of executing the first mode, the control device is configured to:

apply a first charging bias having the same polarity as a charged polarity of toner to the charging member;

apply a first developing bias having the same polarity as the charged polarity of the toner to the developing device; and apply a first cleaning bias having a polarity opposite to the charged polarity of the toner to the cleaning member, and wherein, in a case of executing the second mode, the control device is configured to:

apply a second charging bias having the same polarity as the first charging bias and having an absolute value smaller than the first charging bias to the charging member;

apply a second developing bias having the same polarity as the first developing bias and having an absolute value smaller than the first developing bias to the developing device or not to apply a developing bias to the developing device; and apply a second cleaning bias having the same polarity as the charged polarity of the toner to the cleaning member and set a potential difference between a surface potential of the image carrier and the second cleaning bias within a predetermined range.

9. The image forming apparatus according to claim 8, wherein, in the case of executing the second mode, the control device is configured to apply the second developing bias to the developing device or stop the applying of the developing bias at a timing at which an area of a surface of the image carrier, which is charged by the second charging bias, faces the developing device.

* * * * *